US006698797B2

(12) United States Patent
Lackey et al.

(10) Patent No.: US 6,698,797 B2
(45) Date of Patent: Mar. 2, 2004

(54) HEALTH AND IMMUNIZATION RECORD BOOKLET

(75) Inventors: Scott E. Lackey, Flower Mound, TX (US); James R. Jinright, Flower Mound, TX (US); Kenneth R. Burton, Jr., Houston, TX (US)

(73) Assignee: Medical Documents, Inc., Flower Mound, TX (US)

( * ) Notice: Subject to any disclaimer, the term of this patent is extended or adjusted under 35 U.S.C. 154(b) by 0 days.

(21) Appl. No.: 09/894,271

(22) Filed: Jun. 29, 2001

(65) Prior Publication Data

US 2002/0011729 A1 Jan. 31, 2002

Related U.S. Application Data

(60) Provisional application No. 60/222,020, filed on Jul. 31, 2000.

(51) Int. Cl.[7] ..... B42D 15/00

(52) U.S. Cl. ..... 283/63.1; 283/113; 283/900; 281/38; 281/51; 428/913

(58) Field of Search ..... 283/74, 75, 77, 283/78, 67, 70, 63.1, 900, 113; 8/116.4, 118, 119; 428/913; 281/38, 51, 15.1; 40/771

(56) References Cited

U.S. PATENT DOCUMENTS

| | | | | | |
|---|---|---|---|---|---|
| 5,330,231 | A | * | 7/1994 | Godfrey | 283/77 |
| 5,397,156 | A | * | 3/1995 | Schach et al. | 283/67 |
| 5,464,253 | A | * | 11/1995 | Farrell | 281/38 |
| 5,695,066 | A | * | 12/1997 | Bartlett | 425/317 |
| 6,135,503 | A | * | 10/2000 | Lob et al. | 283/63.1 |

* cited by examiner

*Primary Examiner*—Willmon Fridie, Jr.
(74) *Attorney, Agent, or Firm*—John E. Vandigriff

(57) ABSTRACT

A pocket size booklet for keeping statical records of a particular person from birth and for keeping records of an adult person. Non-tearing waterproof pages made from a synthetic material are used, and the data is printed, or data is written, on the pages with an indelible ink. The pages include a water mark on each page. Pages may include medical history, physical conditions, surgeries, medications, and vaccination records of a person or child. Pages may be provide on which to place the footprints and fingerprints of a new born child.

14 Claims, 20 Drawing Sheets

HEALTH AND IMMUNIZA-
TION RECORD

United States of America

CHILDHOOD HEALTH
AND
IMMUNIZATION RECORD

United States of America

HEALTH RECORD OF

_____

_____

TABLE OF CONTENTS

Personal Information & Birth Statistics..... 2-3
Medical History & Medications Taken Regularly..... 4-5
Family Health History..... 6-7
Genetic Testing and Cord Blood Collection..... 8
Growth Statistics and Percentiles..... 9-11
Developmental Milestones & Special Notes..... 12-13
Infant's Footprints..... 14-15
Child's Fingerprints..... 16
Tuberculosis Screening/Prevention/Treatment..... 17
Consent to Seek Medical Care..... 18-19
Specialists and Other Providers..... 20-21
Quick-Glance of Childhood Immunizations..... 22
Summary of Immunizations Received..... 23
Detailed Vaccination Chart..... 24-26
Yellow Fever Certificate of Vaccination..... 27-30
Health Considerations for Traveling Abroad..... 31
Photo Identification Page..... 32

IMPORTANT: This is your child's personal record of health and of vaccinations received for protection against various diseases, to be utilized for well-child and other medical visits, and presented to your child's regular physician as well as any other health care provider attending to your child. Always consult with your pediatrician/primary care physician regarding health and immunization considerations.

Patent Pending.

Copyright © 2001 Medical Documents International, Inc. All Rights Reserved.
Neither M.D.I. nor this product are affiliated with the United States Government.

FIG 3

Personal Information:

Name of Child

_____

Social Security Number

_____

Mother's Name

_____

Father's Name

_____

Primary Address

_____

State _____

Zip_____

Telephone _____

_____

Alternate Telephone

_____

In Case of Emergency (if parent unavailable), Notify:

Name

_____

Address

_____

_____

FIG 4

| Medical History/Conditions/Surgeries/Appliances | Date (or Ongoing) |
|---|---|
| | |
| | |
| | |
| | |
| | |
| | |
| | |
| | |
| | |
| | |

FIG 5

Statistical Information:

Born on _____/_____/_____ at _____ ❑ a.m. ❑ p.m.

Place of Birth _____

City _____

County _____ State _____

Sex ❑ Male ❑ Female Weight _____lbs., _____oz.

Length: _____ inches Head Circumference: _____ inches

Weight Percentile _____ Length Percentile _____

Blood Type _____ Rh Factor ❑ Positive ❑ Negative

Gestation: _____ wks. Delivery ❑ Normal ❑ Cesarean

Complications of Birth/Infancy _____

_____

_____

_____

Allergies/Sensitivities _____

_____

_____

_____

Organ Donor ❑ Yes ❑ No

Signature of Parental Consent for Organ Donation:

_____

FIG 6

FAMILY HEALTH HISTORY

List number of child's family members, if any, with each of the following:

| | Sister | Brother | Mother | Father | Grand-Mother | Grand-Father | Aunt/ Uncle |
|---|---|---|---|---|---|---|---|
| Birth Defect | | | | | | | |
| Cancer | | | | | | | |
| Diabetes | | | | | | | |
| Deafness | | | | | | | |
| Heart Disease | | | | | | | |
| High Blood Pressure | | | | | | | |
| Kidney Problems | | | | | | | |
| Seizures | | | | | | | |
| Stroke | | | | | | | |
| Turberculosis | | | | | | | |
| Other: | | | | | | | |

FIG 7

| DETAILS OF FAMILY HEALTH HISTORY<br>For each family member with conditions above, please provide any specifics of relation (i.e., paternal or maternal grandparent, aunt or uncle) as well as particulars of condition. |
|---|
| |
| |
| |
| |
| |
| |
| |
| |
| |
| |

FIG 8

| Date: | Height/Length | Percentile | Weight | Percentile |
|---|---|---|---|---|
| Age: | | | | |
| Notes: | | | | |
| Date | Height/Length | Percentile | Weight | Percentile |
| Age: | | | | |
| Notes: | | | | |
| Date: | Height/Length | Percentile | Weight | Percentile |
| Age: | | | | |
| Notes: | | | | |
| Date: | Height/Length | Percentile | Weight | Percentile |
| Age: | | | | |
| Notes: | | | | |

FIG 9

| MEDICATIONS TAKEN REGULARLY (Including Herbal) | | | | |
|---|---|---|---|---|
| **Health Concern** | **Name of Medication** | **Dossage** | **Frequency** | **Physician Prescribed** |
| | | | | |
| | | | | |
| | | | | |
| | | | | |
| | | | | |
| | | | | |
| | | | | |
| | | | | |

FIG 10

| Genetic Testing | If yes, Date |
|---|---|
| Hospital Newborn Screening | |
| Cbr New Screen Program | |
| Other: | |
| Other: | |
| Abnormal Results | |
| Specifics: | |
| | |
| | |
| DNA (Deoxyhribonucleic Acid) | |
| Chromo (chromosome) | |
| Abnormal Results | |
| Specifics: | |
| | |
| | |
| Cord Blood Collected | |
| Public Donation | |
| Private Family storage | |
| Company/Registry Name, Location & Phone Number | |
| | |
| | |
| Patient Identifier: | |
| Number of Nucleated Cells: | |
| Date of Cryopreservation: | |

FIG 11

| Developmental Milestones | |
|---|---|
| Milestone | Date/Age |
| First Smile | |
| First Laugh | |
| Rolls Over (front-to-back) | |
| Rolls Over (back-to-front) | |
| Holds Head Up | |
| Reaches For Toys/Object | |
| Sits Unassisted | |
| Crawls | |
| Pulls Up | |
| Stands Unassisted | |
| First tooth | |
| First Step | |
| First Words | |
| Puts Words Together | |
| Speaks Complete Sentence | |
| First Dental exam | |
| First Hearing Check | |
| First Vision Check | |

FIG 12

SPECIAL NOTES

FIG 13

| Fingerprints | | | |
|---|---|---|---|
| Right-Index | Right-Middle | Right-Ring | Right-Little |
| Left-Index | Left-Middle | Left-Ring | Left-Little |
| Left-Thumb | | Right-thumb | |

| Date: | Age: |
|---|---|

FIG 16

| Tuberculosis Screening, Prevention and Treatment | | |
|---|---|---|
| Date | Procedure | Results |
| | | |
| | | |
| | | |
| | | |
| | | |

| Prescriptions for Prevention or Treatment of Tuberculosis | | |
|---|---|---|
| Date | CPX for Prevention | Rx for Treatment |
| | | |
| | | |
| | | |
| | | |
| | | |

FIG 17

CONSENT TO SEEK MEDICAL CARE

I give my full consent for the following individual(s) to seek medical care for or to accompany my child to doctor's visits in my absence:

(Authorization in force until crossed out. Names of individuals that have been written over correction fluid or tape may not be accepted as being authorized.)

Name of Individual _____
Drivers License/Photo ID # _____
Relationship to Child _____
Signature of Parent _____

Name of Individual _____
Drivers License/Photo ID # _____
Relationship to Child _____
Signature of Parent _____

Name of Individual _____
Drivers License/Photo ID # _____
Relationship to Child _____
Signature of Parent _____

FIG 18

SPECIALISTS & OTHER PROVIDERS

Physician/Provider _____
Area of Specialization _____
Telephone _____
Address _____
_____

Physician/Provider _____
Area of Specialization _____
Telephone _____
Address _____
_____

Physician/Provider _____
Area of Specialization _____
Telephone _____
Address _____
_____

FIG 19

Recommended U.S. Childhood Immunization Schedule

Vaccines are listed under routinely recommended ages. Bars indicate range of recommended ages for immunization. Any dose not give at the recommended age should be given as a "catch-up" immunization at any subsequent visit when indicated and feasible. Ovals indicate vaccines to be given if previously recommended doses were missed or given earlier than the recommended minimum age.

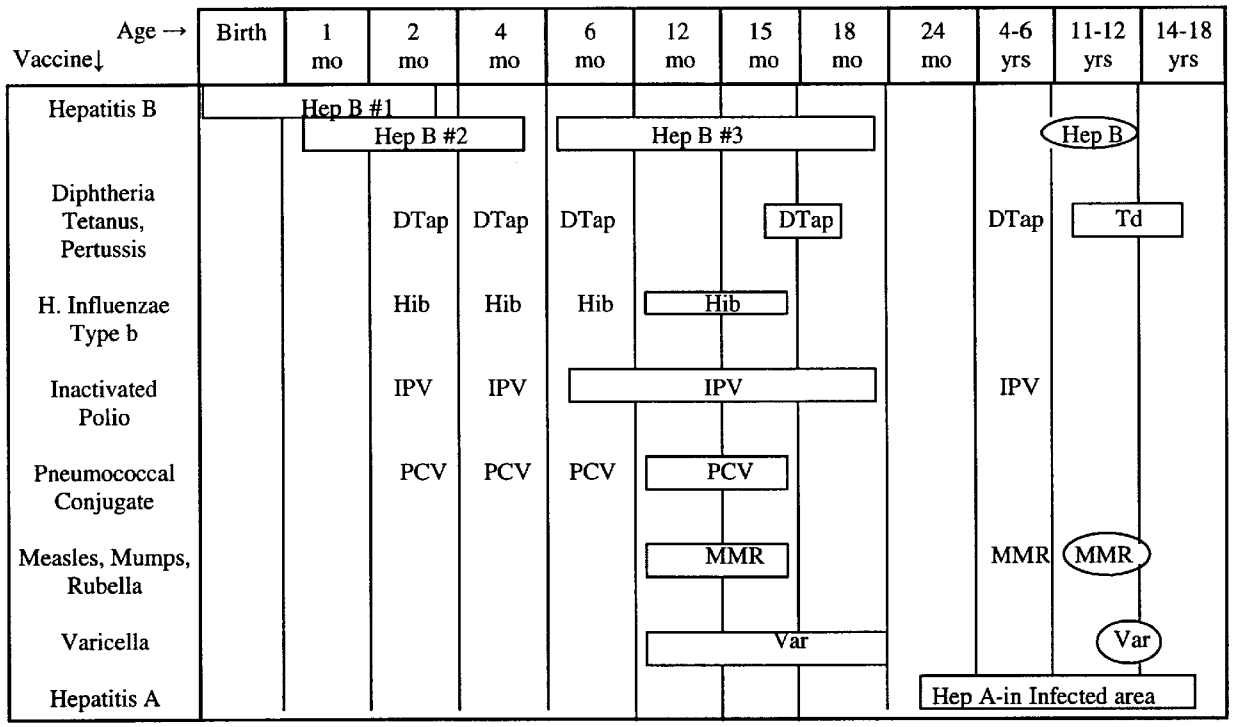

Approved by the Advisory Committee on Immunization Practices (ACIP), the American Academy of pediatrics (AAP), and the America Acadamy of Family Physicians (AAFP)

FIG 20

| SUMMARY OF IMMUNIZATIONS | | | | | |
|---|---|---|---|---|---|
| Date | Vaccine | Provider | Date | Vaccine | Provider |
| | Hep B #1 | | | PCV #1 | |
| | Hep B #2 | | | PCV #2 | |
| | Hep B #3 | | | PCV #3 | |
| | DTap #1 | | | PCV #4 | |
| | DTap #2 | | | MMr #1 | |
| | DTap #3 | | | MMR #2 | |
| | DTap #4 | | | Var | |
| | DTap #5 | | | Hep A #1 | |
| | TD | | | Hep A #2 | |
| | Hib #1 | | | | |
| | Hib #2 | | | | |
| | Hib #3 | | | | |
| | Hib #4 | | | | |
| | IPV #1 | | | | |
| | IPV #2 | | | | |
| | IPV #3 | | | | |

FIG 21

| Vaccine | Date | Age | MFG | Lot # | Exp. Date | Next Due | Provider | Initials |
|---|---|---|---|---|---|---|---|---|
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |

FIG 22

INTERNATIONAL CERTIFICATE OF VACCINATION
AS APPROVED BY
THE WORLD HEALTH ORGANIZATION

CERTIFICAT INTERNATIONAL DE VACCINATION
APPROUVÉ PAR
L'ORGANISATION MONDIALE DE LA SANTÉ

_____
TRAVELER'S NAME - NOM DU VOYAGEUR

_____
ADDRESS - ADRESSE (Number - Numéro) (Street - Rue)

_____
(City - Ville)

_____
(County - Département) (State - État)

_____

HEALTH AND IMMUNIZATION RECORD

INTERNATIONAL CERTIFICATE OF VACCINATION OR REVACCINATION AGAINST YELLOW FEVER
CERTIFICAT INTERNATIONAL DE VACCINATION OU DE REVACCINATION CONTRE LA FIÉVRE JAUNE

This is to certify
Je soussigné(e) cerfitie que

Whose signature follows
don't ia signature suit

Has on the date indicated been vaccinated or revaccinated against yellow fever.

| Date | Signature and professional status of Vaccinator<br><br>Signature et titre du vaccinateur | Manufacturer and Batch no. of vaccine<br><br>Fabrticant du vaccine Et numéro du lot | Official stamp of Vaccinating center<br><br>Cachet official du Centre de vaccination |
|---|---|---|---|
| 1 | | | |
| 2 | | | |
| 3 | | | |
| 4 | | | |

THIS CERTIFICATE IS VALID only if the vaccine used has been approved by the World Health Organization and if the vaccinating center has been designated by the health administration for the country in which the center is situated.
THE VALIDITY OF THIS CERTIFICATE shall extend for a period of 10 years, beginning 10 days after the date of vaccination or, in the event of a revaccination, within such period of 10 years from the date of that revaccination. This certificate must be hand signed by a medical practitioner or other person authorized by the national health administration. An official signature stamp is not acceptable. Any amendment of this certificate, or erasure, or failure to complete any part of it, may render it invalid.

CE CERFIFICAT N'EST VALABLE que si le vaccine employe a été approve par l'Organisation mondiale de la Santé et si le centre de vaccination a été habillité par l'administration sanitary\ire du territoire dans lequel ce centre est situé . LA VALIDITE DE CE CERTIFICAT couvre une période de dix ans commençant dix jours après la date de la vaccination ou, dans le cas d'une revaccination au cours de cette pé riode de dix ans, le jour de cette revaccination. Ce certificate doit étre signé de sa proper main par un médecin ou une autre personne hagilitée par l'administration sanitaire nationale, un cache officel ne pouante etre considéré comme tenant lie de signature. Toute correction ou rapture sur le cerfificat out l'ommision d'une quelconque des mentions qu'il comporte peuf affecter sa validité

FIG 24

How to Complete Your International Certificate of Vaccination

1. Enter your name and address on the cover of the booklet before presenting it to your physician.
2. At the beginning of the Yellow Fever Certificate, print your name on the first line; sign your name on the second line; indicate your sex; and indicate your date of birth in the following sequence: day, month, year. Example: 5 June 1956.
3. It is your responsibility to have the Yellow Fever Certificate validated with an "approved stamp." THE YELLOW FEVER CERTIFICATE IS NOT VALID WITHOUT AN "APPROVED STAMP."

INSTRUCTIONS TO PHYSICIANS

INFORMATION REQUESTED IN EACH SECTION MUST BE COMPLETED FOR THE SECTION TO BE VALID.

1. The dates are to be written with the day in Arabic numerals, followed by the month in letters and the year in Arabic numerals. Example: 2 Jan. 1982.
2. Vaccinations may be given by a licensed physician or under the direct supervision of a qualified medical practitioner. The WRITTEN signature of the physician or other person authorized by the physician must appear on the Certificate. A signature stamp is not acceptable.
3. If yellow fever immunization is required for your patient but is contraindicated on medical grounds, you should complete the "Contraindications Discussed" section of your patient's Health and Immunization Record indicating the nature of the contraindication.
4. It is strongly recommended that persons traveling abroad and those entering the United States be immune from measles by prior disease or vaccination.
5. There is a risk of acquiring MALARIA when traveling to parts of the Caribbean, Central and South America, Africa, the Middle East, the Indian subcontinent, the Far East, and Oceania. For information on malaria prophylaxis, areas where malaria transmission occurs, recommended prophylactic drug regimens, and on preparing patients for international travel, contact your local or State Health Department or call the malaria hotline at 404-332-4555.

FIG 25

HEALTH CONSIDERATIONS FOR TRAVELING ABROAD

The International Certificate of Vaccination or Revaccination is an official statement verifying that proper procedures have been followed to immunize you against a quarantinable disease which could be a threat to the United States and other countries. The Certificate is essential in permitting uninterrupted international travel. IT MUST BE COMPLETE AND ACCURATE IN EVERY DETAIL, or you may be detained at international ports of entry.

Under the International Health Regulations, a country may require an International Certificate of Vaccination only against yellow fever, although individual countries may require certain immunizations. Vaccination against smallpox is NOT required by any country. NO immunizations are required to return to the United States. Yellow fever immunization may be given only by a designated Yellow Fever Vaccination Center. Other immunizations may be given by any licensed physician or clinic. Your local or State Health Department can inform you where in your area you may be vaccinated against yellow fever and have your Certificate validated.

Prophylactic medication for malaria and certain other preventive measures are advisable for some travelers; check with your health care provider or local health department. Also ensure that your immunizations for measles, mumps, rubella, polio, diphtheria, tetanus and pertussis are up-to-date. Further information regarding immunization and prophylaxis requirements and recommendations is available through the travelers' hotline at 404-332-4555.

If you need medications regularly, take an adequate supply with you. Because of possible serious consequences to your health, do NOT buy medications "over the counter" unless you are familiar with the product. Should you need medical assistance, the American Embassy or consulate usually can provide names of physicians or hospitals. If you should become ill upon returning to the United States, inform your physician of your recent travels abroad.

FIG 26

Medical Documents International, Inc.
6021 Morriss Road, Suite #101
Flower Mound, TX 75028
Phone: 972-874-9696 Fax: 972-724-1922
E-mail: mail@medical-docs.com
Website: www.medical-docs.com

PASTE PHOTO HERE (Profile)

PASTE PHOTO HERE (Full Face)

Identifying Marks, Moles, Scars, Etc.: _____

_____

_____

_____

PERMANENT RECORD - Keep in Safe Place!

FIG 27

HEALTH AND IMMUNIZATION RECORD BOOKLET

This application claims the benefit of provisional application No. 60/202,020 filed on Jul. 21, 2000.

FIELD OF THE INVENTION

The invention relates to records documents, and more particularly to a records document booklet for health and immunization data, the booklet having water proof pages on which the data is transcribed in indelible ink.

BACKGROUND OF THE INVENTION

Booklets with various type of information exist for recording data. An example of a booklet structure is described in U.S. Pat. No. 6,135,503. Described is a booklet structure in which the data sheet is placed into a laminate only in the area of the data sheet where there is information to be protected. This structure leaves the data sheet in a single layer at the seam where the booklet pages are secured together.

A booklet is described in U.S. Pat. No. 6,089,608, in which the front and back cover have a vinyl pocket on the inside of the front and back covers. A plurality of leaves or pages are then attached inside of the cover.

An emergency medical card is described in U.S. Pat. No. 5,197,763, which consists of a reduced in size printed document that is laminated between plastic sheets.

SUMMARY OF THE INVENTION

The invention is a pocket size booklet for keeping statistical records of a particular person from birth. It may also be used for keeping records of an adult person. Non-tearing waterproof pages of a synthetic material, for example, Tyvek®. Tyvek® is made from very fine, high-density polyethylene fibers which is lightweight, vapor-permeable, but water, chemical, puncture and tear resistant. Data is printed, or data is written, on the pages with an indelible ink. The pages include a water mark on each page. Pages may include medical history, physical conditions, surgeries, medications, and vaccination records of a person or child. Pages may be provided on which to place the footprints and fingerprints of a new born child.

BRIEF DESCRIPTION OF THE DRAWINGS

FIG. 3 shows the Health record Table of Contents;

FIG. 4 shows personal information page for a child;

FIG. 5 shows a page for Statistical Information;

FIG. 6 shows a page for a Medical History;

FIG. 7 shows a page for Family Health History;

FIG. 8 shows a page of Family Health History details;

FIG. 9 shows a page for weight and height history;

FIG. 10 shows a page for Medications taken on a regular basis;

FIG. 11 shows a page for genetic testing and hospital newborn screening, including DNA and cord blood;

FIG. 12 shows a page for child developmental milestones;

FIG. 13 shows a page to contain notes;

FIG. 16 shows a page for an infant's finger prints;

FIG. 17 shows a page for tuberculosis screening;

FIG. 18 shows a page for Consent to Seek Medical Care;

FIG. 19 shows a page for Specialist and other health providers;

FIG. 20 shows a page of recommended childhood immunizations;

FIG. 21 is a page for summary of immunizations;

FIG. 22 is a page for listing immunizations;

FIG. 24 is an International Certificate of Vaccination against yellow fever;

FIG. 25 shows instructions for completing the International Certificate of Vaccination;

FIG. 26 list health considerations for traveling abroad;

FIG. 27 provides a place for photos, full face and profile, in the Health Record;

DESCRIPTION OF A PREFERRED EMBODIMENT

The invention is a Health and Immunization book, and it is constructed to provide a record of health, immunization, and other records for a person. In one embodiment, pages are included for records beginning with the birth of a child. If started later in life, then records are provided for an adult. The booklet is constructed on water proof, pages that will not tear, and writing or printing is done with an indelible ink so that information in the booklet becomes permanently affixed, and so water and other substances will not fade the information.

Figure 1:
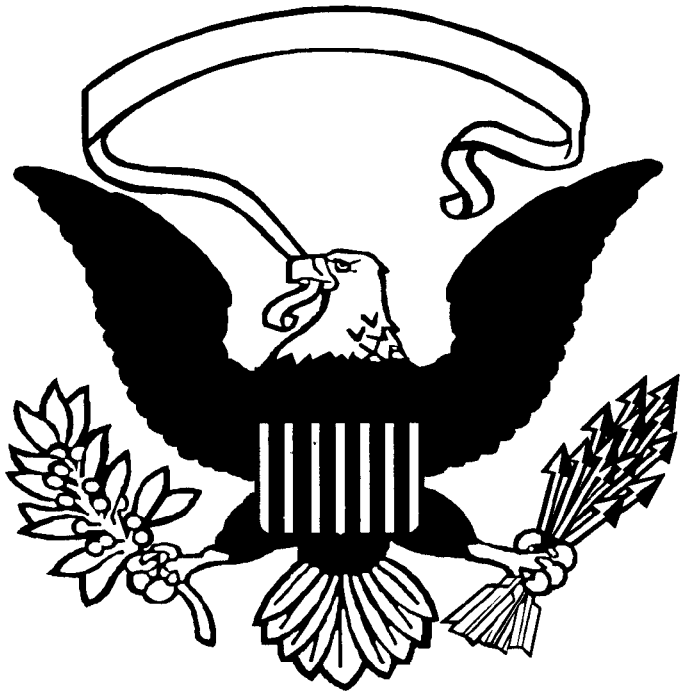
FIG. 1 illustrates a cover for a Health and Immunization record.
Figure 2:
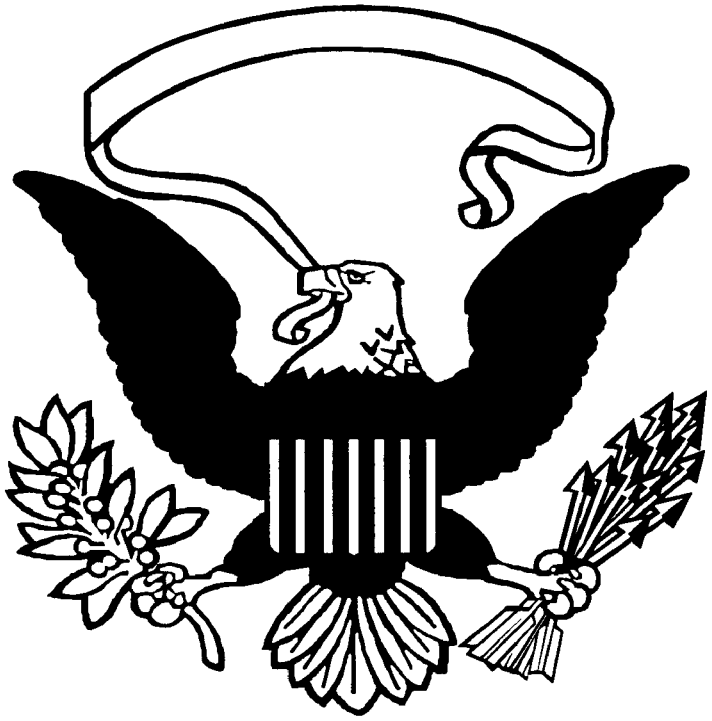
FIG. 2 illustrates a cover for a Childhood Health and Immunization record.

FIG. 1 shows an example of a cover that may be used for a person start at, or after birth. FIG. 2 shows an example of a cover that may be used on a booklet for a child, commencing at, or after birth. While either cover may be utilized, one as illustrated in FIG. 2 would, in a family, indicate a child record, while the cover in FIG. 1 would indicate the booklet used by an adult.

In FIG. 3, is shown an example of a Table Of Contents. This Table of Contents shows, at least in part, the information that may be recorded in the Heath Record Booklet. It provides a list of the basic health information that may be needed for a child to show what immunizations, disease, and other illness that the child may have had.

FIG. 4 list the basic information for the child in relation to residency, parents' names, and at least one name and address for emergency purposes.

FIG. 5 provides space to list medical history information, special medical conditions of the person, and any appliances used by the person.

A record of statistical information at birth, and later, is listed on the page illustrated in FIG. 6. It allows recording basic birth information, blood type, and allergies.

In diagnosing illnesses, it is at times desirable to have a family health history. This may indicate potential health factors of the child. A Family Health History may be listed on the page illustrated in FIG. 7. Space is available for family and grand parent information. To record the details of family health history, a page as illustrated in FIG. 8 may be used.

The page of FIG. 9 is for recording height, weight, and national percentile by age. This may be on at least three different ages. Notes may also be recorded.

Physician often inquire into medications taken on a regular basis. In treating a person, it is desirable to know what medications that a person is taking in order to avoid givin other medications that will conflict with previous prescribed medicines. FIG. 10 provides a listing of medications taken on a regular basis.

To record genetic testing performed on a person, a page such as that illustrated in FIG. 11 may be used. Further developments of a child are shown in FIG. 12, and special notes may be recorded on the page illustrated in FIG. 13.

Figure 15:
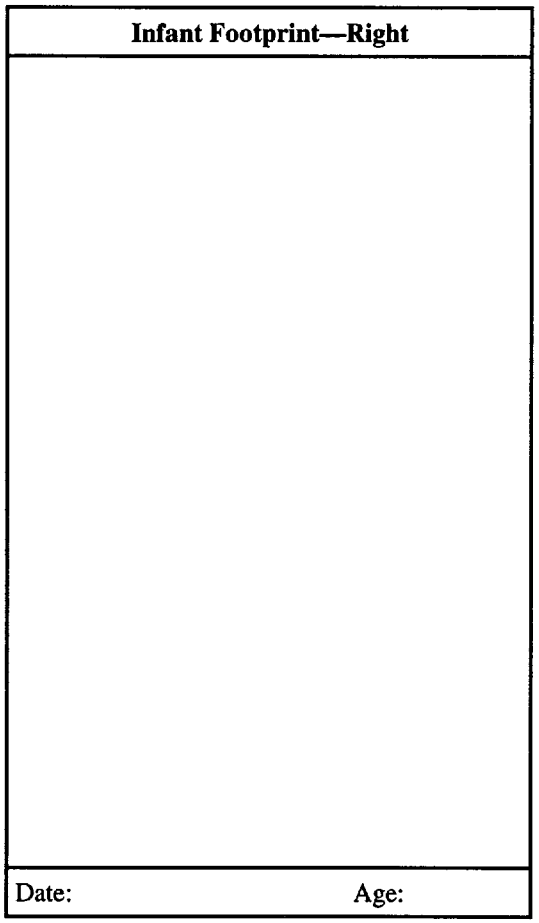
FIG. 15 shows a page for an infant's right foot print.
Figure 14:
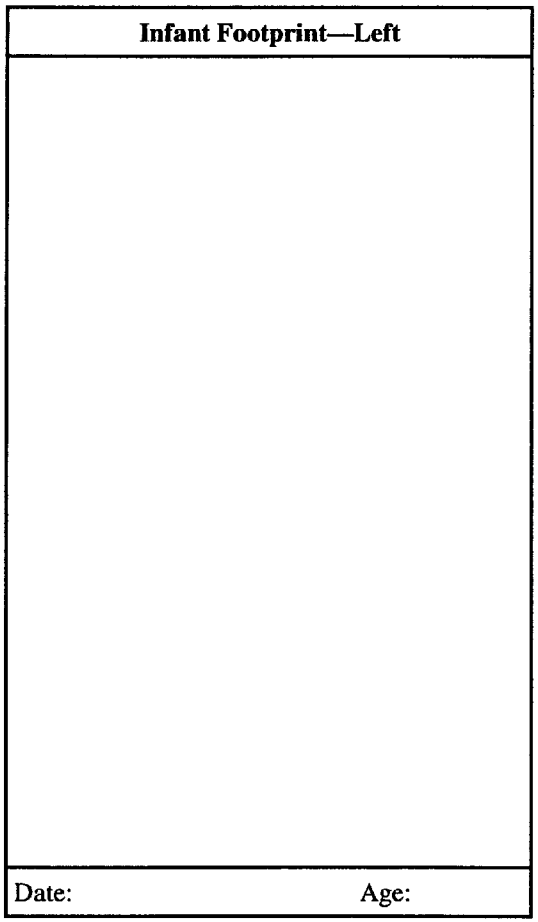
FIG. 14 shows a page for an infant's left foot print.

For identification purposes, an infants footprints may be placed on the pages illustrated in FIG. 14 and FIG. 15, and finger prints are recorded on the page illustrated in FIG. 16.

Information regarding tuberculosis, prescriptions given, or preventative for treatment may be recorded on the page illustrated in FIG. 17.

Normally when a parent leaves a child with a family member or other person, a consent paper is given to permit the family member or person to seek medical care for the child if necessary. This consent is listed on the page illustrated in FIG. 18. To accompany the consent, a listing of physicians for treating the child are given in FIG. 19.

Children, as they are growing up, re required to have a number of immunizations. A suggested or recommended schedule of immunizations are shown in FIG. 20. This listing will help parents to know when it is best to have their child immunized during the child's early life. To maintain a list of immunizations, the pages illustrated in FIG. 21 and FIG. 22 allow listing of dates of immunizations and the vaccines used.

Figure 23:
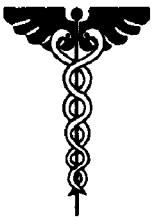
FIG. 23 is an International Certificate of Vaccination against yellow fever.

When traveling abroad, it may be necessary to have specific immunizations for traveling to specific countries. A cover traveler information sheet is shown in FIG. 23, and the International Certificate of Vaccination against yellow fever, with instructions, is illustrated in FIG. 24. Instructions how to complete the International Certificate of Vaccination is shown in FIG. 25. Health Considerations for traveling abroad is outlined in FIG. 26. For purposes of identifying the person to whom the booklet belongs, photos and a listing of identifying marks or scars may be inserted in the page illustrated in FIG. 27.

Figure 28:
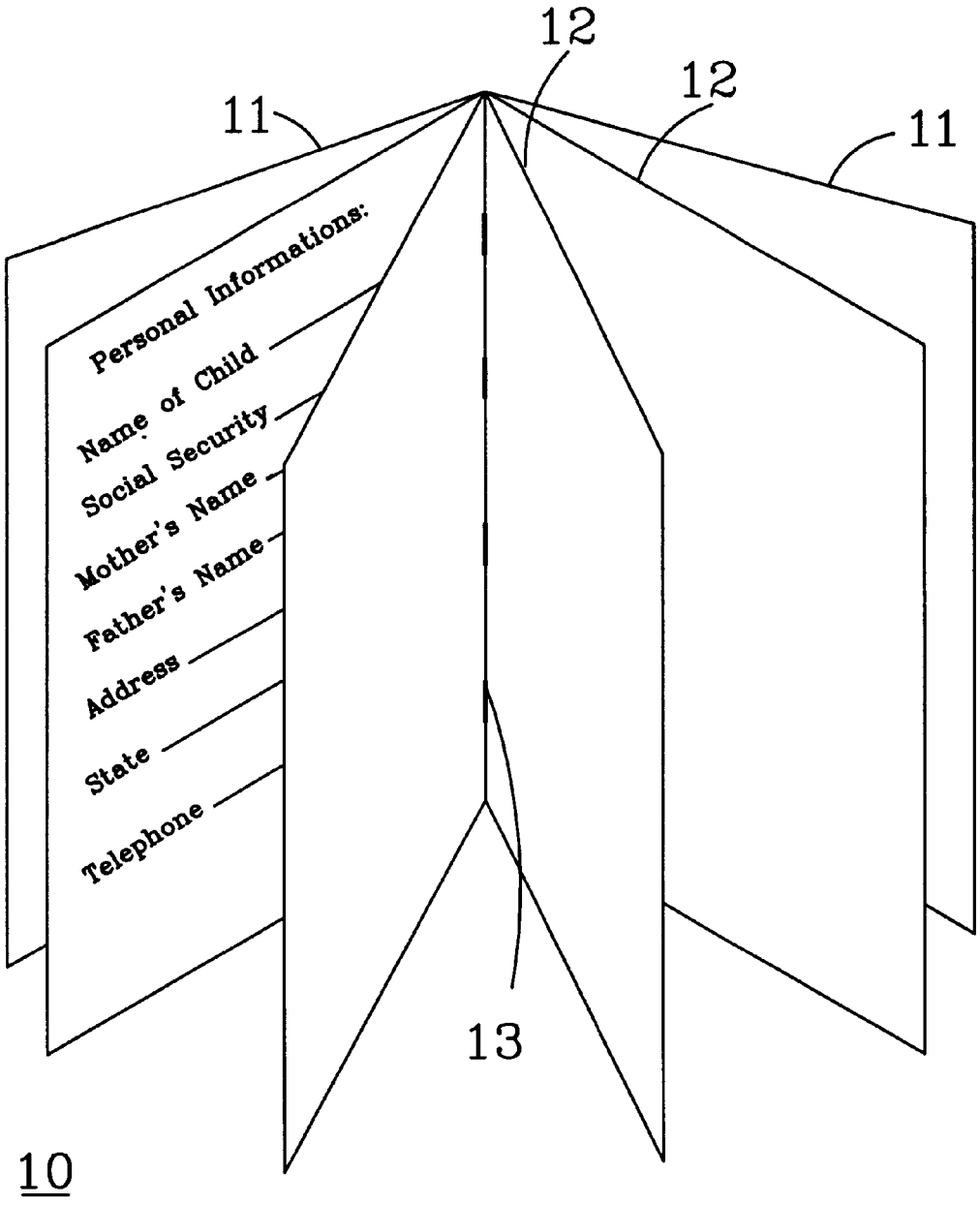
FIG. 28 shows an example for construction of the Health Record Book.

FIG. 28 shows the basic structure of the Health and Immunization Record Booklet 10. The booklet may be constructed using a single saddle fold or may use several signatures. An important feature of the booklet is that the pages are made of a synthetic, non-tearing waterproof material. One example of such a material is the material Tyvek®. To provide a water-proof document, the printing in the booklet is made with a water proof or indelible ink, and the notations inserted in the booklet should also be made with an indelible or water proof ink.

Each page is 12 is secured in a cover 11 by fasteners 13. Fasteners 13 may be staples or a stitching, preferably of a plastic, metallic, or synthetic material.

Figure 29:
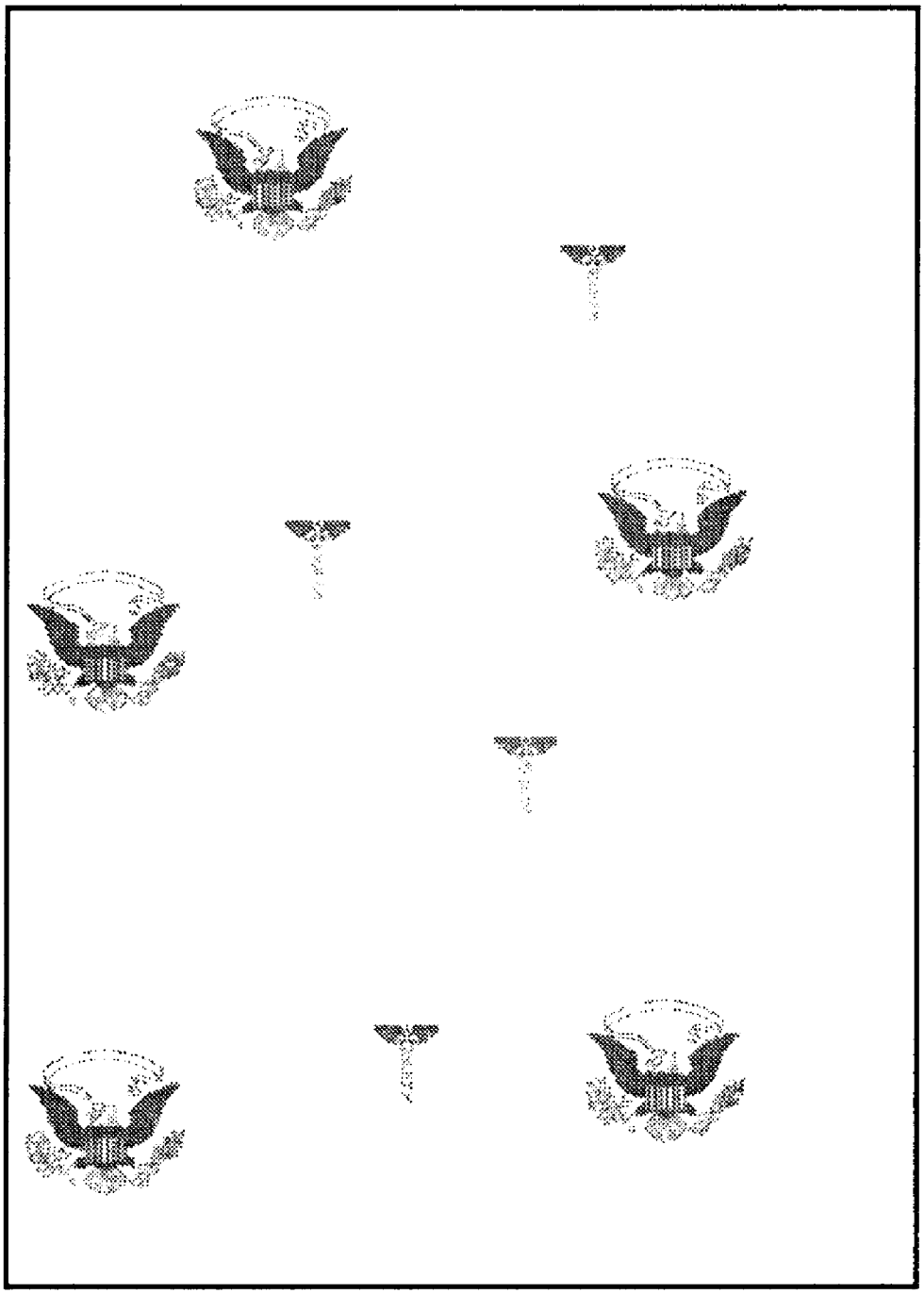
FIG. 29 shows the watermarks for each of the pages.

Another feature of the booklet pages is that each page has a watermark as illustrated in FIG. 29. This prevents the insertion of pages into the booklet assuring that the contents of the booklet are original and permanent.

What is claimed:

1. A Health and Immunization booklet, comprising:

a cover;

a plurality of pages, each page made from a single layer synthetic waterproof material; and printing on the pages including forms for documenting the medical and immunization history of a person.

2. The Health and Immunization booklet according to claim 1, wherein said pages are in a single saddle fold with at least one signature, and include an authenticating watermark.

3. The Health and Immunization booklet according to claim 1, having pages including printed areas and documented instructions for recording the foot and fingerprints of an infant.

4. The Health and Immunization booklet according to claim 1, wherein said booklet pages are made from a high density polyethylene fiber material which is lightweight, vapor-permeable, but water, chemical, puncture and tear resistant material.

5. The Health and Immunization booklet according to claim 1, including a printed form on a page for documenting an International Certificate of Vaccination against yellow fever.

6. The Health and Immunization booklet according to claim 1, wherein said pages have printed forms thereon for documenting the medical history of a person beginning at birth.

7. The Health and Immunization booklet according to claim 6, including pages having imprinted forms for showing family medical history.

8. A Health and Immunization booklet, comprising:

a cover;

a plurality of single layer synthetic material pages made from a high density polyethylene fiber material which is lightweight, vapor-permeable, but water, chemical, puncture and tear resistant material;

printing on the pages including forms for documenting the medical and immunization history of a person; and an authenticating watermark on each page.

9. The Health and Immunization booklet according to claim 8, having pages including printed areas and documented instructions for recording the foot and fingerprints of an infant.

10. The Health and Immunization booklet according to claim 8, including a printed form on a page for documenting an International Certificate of vaccination against yellow fever.

11. The Health and Immunization booklet according to claim 8, wherein said pages have forms imprinted thereon for documenting the medical history of a person beginning at birth.

12. The Health and Immunization booklet according to claim 11, including pages having imprinted forms for showing family medical history.

13. A Health and Immunization booklet, comprising:

a cover;

a plurality of synthetic material pages made from a single layer of high density polyethylene fiber material which is lightweight, water, chemical, puncture and tear resistant material in said cover, said pages having a single saddle fold;

an authenticating watermark on each page; and a plurality of said pages having forms imprinted thereon for documenting the medical history of a person beginning at birth.

14. A Health and Immunization booklet, according to claim 1, including pages with forms imprinted thereon for recording DNA and cord blood testing, and newborn screening.

* * * * *